US011812208B2

(12) United States Patent
Hua et al.

(10) Patent No.: US 11,812,208 B2
(45) Date of Patent: Nov. 7, 2023

(54) WIRELESS EARPHONE NOISE REDUCTION METHOD AND DEVICE, WIRELESS EARPHONE, AND STORAGE MEDIUM

(71) Applicant: GOERTEK INC., Shandong (CN)

(72) Inventors: Yang Hua, Shandong (CN); Yang Du, Shandong (CN); Shanshan Jiao, Shandong (CN); Chen Liu, Shandong (CN)

(73) Assignee: GOERTEK INC., Shandong (CN)

( * ) Notice: Subject to any disclaimer, the term of this patent is extended or adjusted under 35 U.S.C. 154(b) by 284 days.

(21) Appl. No.: 17/594,137

(22) PCT Filed: Dec. 28, 2019

(86) PCT No.: PCT/CN2019/129511
§ 371 (c)(1),
(2) Date: Oct. 4, 2021

(87) PCT Pub. No.: WO2021/047115
PCT Pub. Date: Mar. 18, 2021

(65) Prior Publication Data

US 2022/0201383 A1 Jun. 23, 2022

(30) Foreign Application Priority Data

Sep. 11, 2019 (CN) ..... 201910860393.6

(51) Int. Cl.
*H04R 1/10* (2006.01)
*H04R 3/00* (2006.01)

(52) U.S. Cl.
CPC ..... *H04R 1/1083* (2013.01); *H04R 1/1016* (2013.01); *H04R 1/1041* (2013.01); *H04R 3/005* (2013.01)

(58) Field of Classification Search
CPC .. H04R 1/1083; H04R 1/1016; H04R 1/1041; H04R 3/005
(Continued)

(56) References Cited

U.S. PATENT DOCUMENTS

2013/0024194 A1* 1/2013 Zhao ..... G10L 21/0208 704/E21.002
2016/0330541 A1* 11/2016 Miao ..... H04R 29/008
(Continued)

FOREIGN PATENT DOCUMENTS

CN 102411936 A 4/2012
CN 107547967 A 1/2018
(Continued)

OTHER PUBLICATIONS

International Search Report, English translation, from PCT/CN2019/129511 filed Dec. 28, 2019, dated Jun. 11, 2020.

*Primary Examiner* — William A Jerez Lora
(74) *Attorney, Agent, or Firm* — HAUPTMAN HAM, LLP

(57) ABSTRACT

A method and a device for reducing noise of a wireless-earphone, a wireless-earphone and a computer-readable storage medium are provided. In the method, a first electromagnetic signal from a slave earphone is received, and the first electromagnetic signal is converted to an audio signal. The first electromagnetic signal is obtained by a coil inducing an audio signal acquired by a microphone in the slave earphone. A to-be-denoised earphone is determined based on audio signals acquired by microphones in the earphones. It is determined whether an audio signal acquired by a microphone in the to-be-denoised earphone has a voice feature. Noise reduction processing is performed on the audio signal acquired by the microphone in the to-be-denoised earphone by using a filter in a case that the audio signal acquired by
(Continued)

the microphone in the to-be-denoise earphone has the voice feature.

11 Claims, 5 Drawing Sheets

(58) Field of Classification Search
USPC ..... 381/71.1, 94.1, 122, 311, 312
See application file for complete search history.

(56) References Cited

U.S. PATENT DOCUMENTS

| | | | | |
|---|---|---|---|---|
| 2017/0352360 | A1* | 12/2017 | Thoen | H04R 1/1083 |
| 2020/0404417 | A1* | 12/2020 | Matsuda | H04R 1/1083 |
| 2021/0144498 | A1* | 5/2021 | Yan | H04R 1/1016 |

FOREIGN PATENT DOCUMENTS

| | | | | |
|---|---|---|---|---|
| CN | 108337594 | A | 7/2018 | |
| CN | 108551604 | A | 9/2018 | |
| CN | 108768467 | A | 11/2018 | |
| CN | 108810746 | A | 11/2018 | |
| CN | 109068217 | A | 12/2018 | |
| CN | 106151211 | A | 1/2019 | |
| CN | 109905798 | A | 6/2019 | |
| CN | 208940178 | U | 6/2019 | |
| CN | 209002161 | U | 6/2019 | |
| CN | 110475178 | A | 11/2019 | |
| JP | 2009017485 | A | 1/2009 | |
| WO | WO-2019218368 | A1 * | 11/2019 | G06F 1/163 |
| WO | WO-2019218369 | A1 * | 11/2019 | G06F 3/16 |

* cited by examiner

WIRELESS EARPHONE NOISE REDUCTION METHOD AND DEVICE, WIRELESS EARPHONE, AND STORAGE MEDIUM

This application is a national phase of International Patent Application No. PCT/CN2019/129511, titled "WIRELESS EARPHONE NOISE REDUCTION METHOD AND DEVICE, WIRELESS EARPHONE, AND STORAGE MEDIUM", filed on Dec. 28, 2019, which claims the priority to Chinese Patent Application No. 201910860393.6 titled "WIRELESS EARPHONE NOISE REDUCTION METHOD AND DEVICE, WIRELESS EARPHONE, AND STORAGE MEDIUM", filed on Sep. 11, 2019 with the Chinese Patent Office, of which are incorporated herein by reference in their entireties.

FIELD

The present disclosure relates to the technical field of wireless-earphones, and in particular to a method and a device for reducing noise of a wireless-earphone, a wireless-earphone and a computer-readable storage medium.

BACKGROUND

According to the conventional technology, a left earphone of a wireless-earphone and a right earphone of the wireless-earphone are connected via a connection line. In the connection line, a power line, a statistical process control (spk) line and some digital control signal lines are included. In order to meet the requirements of the user for a compact appearance, microphones (mics) in the left earphone or the right earphone are arranged close to each other, the number of the microphones is generally less than or equal to two, and the earphone has a low noise reduction quality. In addition, periodic noise is generated due to that the spk or the mic is interfered by crosstalk between the digital signal lines in the connection line, and an echo is generated due to that the mic line is interfered by crosstalk between signals in the spk line, further reducing the noise reduction quality.

Therefore, how to improve the noise reduction quality of the wireless-earphone is a technical problem to be solved by those skilled in the art.

SUMMARY

A method and a device for reducing noise of a wireless-earphone, a wireless-earphone and a computer-readable storage medium are provided according to the present disclosure, to improve the noise reduction quality of the wireless-earphone.

To achieve the above objective, a method for reducing noise of a wireless-earphone is provided according to the present disclosure. Each of earphones included in the wireless-earphone is arranged with multiple microphones, and the earphones are electromagnetically connected with each other via coils. The method is applied to a master earphone of the wireless-earphone. The method includes:

receiving a first electromagnetic signal from a slave earphone, and converting the first electromagnetic signal to an audio signal, where the first electromagnetic signal is obtained by a coil inducing an audio signal acquired by a microphone in the slave earphone;

determining a to-be-denoised earphone based on audio signals acquired by microphones in the earphones;

determining whether an audio signal acquired by a microphone in the to-be-denoised earphone has a voice feature;

performing noise reduction processing on the audio signal acquired by the microphone in the to-be-denoised earphone by using a filter in a case that the audio signal acquired by the microphone in the to-be-denoised earphone has the voice feature.

In an embodiment, the determining a to-be-denoised earphone based on audio signals acquired by microphones in the earphones includes:

determining, for each of the earphones, an enabling parameter corresponding to the earphone based on a predetermined sound pressure range and an audio signal acquired by a microphone in the earphone, where the enabling parameter is positively correlated with a sound energy of the audio signal;

in a case that a first enabling parameter and a second enabling parameter are both less than a predetermined value, determining the master earphone as the to-be-denoised earphone, where the first enabling parameter and the second enabling parameter correspond to different earphones;

in a case that at least one of a first enabling parameter and a second enabling parameter is greater than or equal to a predetermined value and a difference between the first enabling parameter and the second enabling parameter is not within a predetermined range, determining an earphone corresponding to a target enabling parameter as the to-be-denoised earphone, where the target enabling parameter is a minimum of the first enabling parameter and the second enabling parameter; and in a case that at least one of a first enabling parameter and a second enabling parameter is greater than or equal to a predetermined value and a difference between the first enabling parameter and the second enabling parameter is within a predetermined range, determining each of the earphones as the to-be-denoised earphone.

In an embodiment, the determining whether an audio signal acquired by a microphone in the to-be-denoised earphone has a voice feature includes:

performing envelope detection on the audio signal acquired by the microphone in the to-be-denoised earphone to obtain an envelope energy;

performing, in a case that the envelope energy is greater than a first threshold, zero-crossing rate detection on the audio signal acquired by the microphone in the to-be-denoised earphone to obtain a zero-crossing rate; and determining, in a case that the zero-crossing rate is greater than a second threshold, that the audio signal acquired by the microphone in the to-be-denoised earphone has the voice feature.

In an embodiment, the performing noise reduction processing on the audio signal acquired by the microphone in the to-be-denoised earphone by using a filter includes:

determining a controlling parameter of the filter based on the envelope energy of the audio signal acquired by the microphone in the to-be-denoised earphone, where the controlling parameter represents an updating speed of a weight of the filter, and a constraint of the filter is equal to a product of the controlling parameter and the weight; and performing the noise reduction processing on the audio signal acquired by the microphone in the to-be-denoised earphone by using the filter.

In an embodiment, the determining a controlling parameter of the filter based on the envelope energy of the audio signal acquired by the microphone in the to-be-denoised earphone includes:

determining the envelope energy of the audio signal acquired by the microphones in the to-be-denoised earphone as a first envelope energy;

selecting a candidate microphone other than the microphone to perform envelope detection on an audio signal acquired by the candidate microphone to obtain a second envelope energy; and determining the controlling parameter of the filter based on a ratio of the first envelope energy to the second envelope energy, where the controlling parameter is negatively correlated with the ratio, and the updating speed of the weight of the filter is positively correlated with the controlling parameter.

In an embodiment, in a case that each of the earphones is the to-be-denoised earphone, after performing noise reduction processing on the audio signal acquired by the microphone in the to-be-denoised earphone by using the filter, the method further includes:

receiving a second electromagnetic signal from the slave earphone, and converting the second electromagnetic signal to an audio signal, where the second electromagnetic signal is obtained by the coil inducing an audio signal after noise reduction processing by the slave earphone; and fusing all audio signals after noise reduction processing to obtain an output signal.

In an embodiment, the fusing all audio signals after noise reduction processing to obtain an output signal includes:

performing time-frequency domain conversion on all the audio signals after noise reduction processing to obtain multiple frequency-domain signals;

performing cepstrum processing on each of the frequency-domain signals, and performing signal fusion in a cepstrum domain to obtain a fused signal;

performing inverse cepstrum processing on the fused signal to obtain a target frequency-domain signal, and converting the target frequency-domain signal to a target time-domain signal; and determining the target time-domain signal as the output signal.

To achieve the above objective, a device for reducing noise of a wireless-earphone is provided according to the present disclosure. Each of earphones included in the wireless-earphone is arranged with multiple microphones, and the earphones are electromagnetically connected with each other via coils. The device is applied to a master earphone of the wireless-earphone. The device includes a first receiving module, a determination module, a detection module and a noise reduction module. The first receiving module is configured to receive a first electromagnetic signal from a slave earphone, and convert the first electromagnetic signal to an audio signal. The first electromagnetic signal is obtained by a coil inducing an audio signal acquired by a microphone in the slave earphone. The determination module is configured to determine a to-be-denoised earphone based on audio signals acquired by microphones in the earphones. The detection module is configured to determine whether an audio signal acquired by a microphone in the to-be-denoised earphone has a voice feature, and trigger a noise reduction module to operate in a case that the audio signal acquired by the microphone in the to-be-denoised earphone has the voice feature. The noise reduction module is configured to perform noise reduction processing on the audio signal acquired by the microphone in the to-be-denoised earphone by using a filter.

To achieve the above objective, a wireless-earphone is provided according to the present disclosure. Each of earphones included in the wireless-earphone is arranged with multiple microphones, and the earphones are electromagnetically connected with each other via coils. A master earphone of the wireless-earphone includes a memory and a processor. The memory stores a computer program. The processor is configured to perform, when executing the computer program, the method for reducing noise of a wireless-earphone.

In an embodiment, each of the coils is arranged with magnetic conductive material.

To achieve the above objective, a computer-readable storage medium is provided according to the present disclosure. The computer-readable storage medium stores a computer program. The computer program, when executed by a processor, causes the processor to perform the method for reducing noise of a wireless-earphone described above.

Based on the above solutions, the method for reducing noise of a wireless-earphone according to the present disclosure includes: receiving a first electromagnetic signal from a slave earphone, and converting the first electromagnetic signal to an audio signal, where the first electromagnetic signal is obtained by a coil inducing an audio signal acquired by a microphone in the slave earphone; determining a to-be-denoised earphone based on audio signals acquired by microphones in the earphones; determining whether an audio signal acquired by a microphone in the to-be-denoised earphone has a voice feature; and performing noise reduction processing on the audio signal acquired by the microphone in the to-be-denoised earphone by using a filter in a case that the audio signal acquired by the microphone in the to-be-denoised earphone has the voice feature.

In the method for reducing noise of a wireless-earphone according to the present disclosure, no connection line is arranged between the left earphone and the right earphone, improving wearing experience of the user. The communication between the two earphones is performed through wireless electromagnetic waves, avoiding the interference between the signal lines according to the conventional technology, thereby achieving high-quality signal transmission. With the method according to the present disclosure, mic noise reduction design is performed in each of the left earphone and the right earphone, and the to-be-denoised earphone can be determined based on an actual audio signal, thereby improving the quality of noise reduction processing and the communication experience of the user. According to the present disclosure, a device for reducing noise of a wireless-earphone, a wireless-earphone and a computer-readable storage medium are further provided. With the device for reducing noise of a wireless-earphone, the wireless-earphone and the computer-readable storage medium, the above technical effects can also be achieved.

It should be understood that the above general description and the following detailed description are only exemplary and are not intend to limit the present disclosure.

BRIEF DESCRIPTION OF THE DINITIALINGS

In order to more clearly illustrate technical solutions in the embodiments of the present disclosure or in the conventional technology, the drawings to be used in the description of the embodiments or in the conventional technology are briefly described below. Apparently, the drawings in the following description show only some embodiments of the present disclosure, and other drawings may be obtained by those skilled in the art from the drawings without any creative work. The drawings described herein are intended to provide a further understanding of the present disclosure and constitute a part of the specification. The drawings and the following embodiments are intended to explain the technical disclosure, and are not intended to limit the present disclosure. In the drawings:

DETAILED DESCRIPTION OF EMBODIMENTS

Hereinafter, the technical solutions according to the embodiments of the present disclosure are described clearly and completely in conjunction with the drawings in the embodiments of the present disclosure. It is apparent that the described embodiments are only a few rather than all of the embodiments of the present disclosure. All other embodiments obtained by those skilled in the art based on the embodiments of the present disclosure without any creative work fall in the protection scope of the present disclosure.

Figure 1:
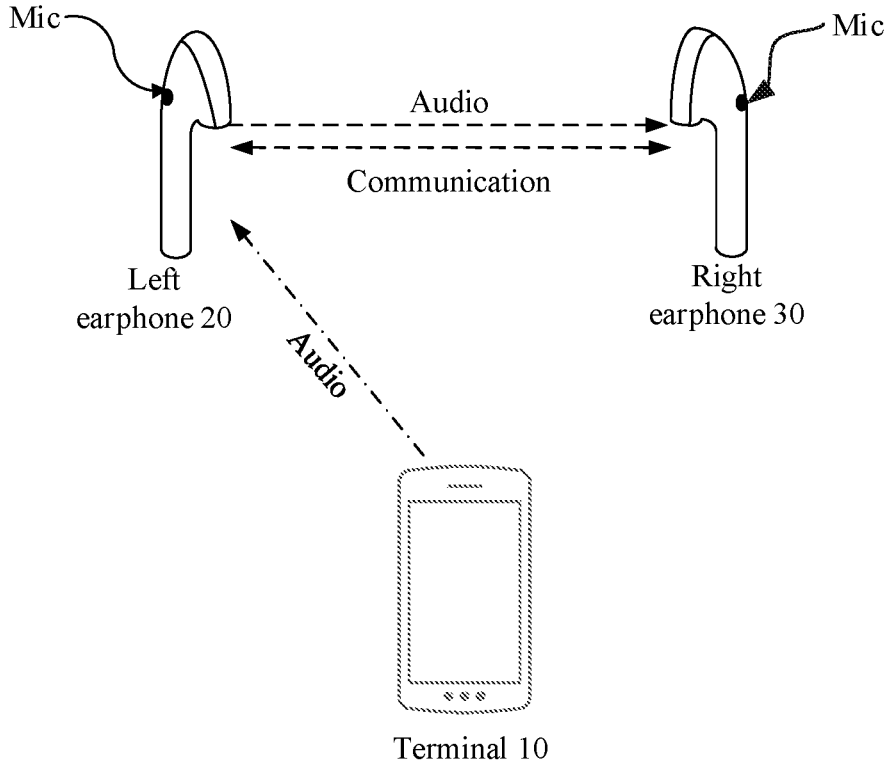
FIG. 1 is a schematic diagram showing a communication architecture according to an exemplary embodiment.

In order to facilitate the understanding of the method for reducing noise of a wireless-earphone according to the embodiments, a communication architecture to which the method is applied is described below. As shown in FIG. 1, the communication architecture includes a terminal 10 and a wireless-earphone. The wireless-earphone may be a compact in-ear earphone, a headphone or an on-ear earphone, which is not limited herein.

The wireless-earphone includes a left earphone 20 and a right earphone 30. Each of the left earphone 20 and the right earphone 30 is arranged with mics for acquiring an audio signal. The number of the mics in the earphones is not limited in the embodiment, and each of the earphones may include at least two mics.

In an embodiment, one of the left earphone and the right earphone may be selected to serve as a master earphone, and the other one of the left earphone and the right earphone serves as a slave earphone. For example, the left earphone 10 is selected to serve as the master earphone. In the embodiment, a master-slave forwarding manner is adopted. That is, the master earphone is communicably connected with the terminal 10, and the master earphone is electromagnetically connected with the slave earphone.

In the embodiment, each of the left earphone 20 and the right earphone 30 is arranged with a coil. A multichannel digital signal (such as a time division multiplexing signal or a frequency division multiplexing signal) and an analog signal are induced by magnetic conductive material based on an alternating magnetic field generated by a coil in one earphone, and then are transmitted to a coil in the other earphone, so that the multichannel digital signal is transmitted from one earphone to the other earphone. Since mutual crosstalk is not to be generated due to the transmission of the digital signal in a magnetic conductive material, the electrical problems such as noise and crosstalk are solved. The material of the coil is not limited herein. Metals with high conductivity, such as an oxygen-free copper or other high-purity metals, may be used. It is usually required to perform close processing and multi-layer processing on a coil which is to be applied to a compact wireless-earphone, thereby enhancing an electromagnetic field generated by the coil and improving the efficiency of converting the magnetic field to an electrical signal.

In an embodiment, each of the coils is arranged with magnetic conductive material. The magnetic conductive material is arranged in the coil to effectively improve conversion efficiency of electromagnetic induction, increase transmission distance between the left earphone and the right earphone, and avoid packet loss during signal transmission between the left earphone and the right earphone. In addition, the speed of transmitting information based on the magnetic conductive material is close to the speed of transmitting information based on electromagnetic waves, thereby achieving high-speed transmission and providing a basic guarantee for synchronous processing of signals of mics in the left earphone and the right earphone. The type of magnetic conductive material is not limited herein. The magnetic material may be selected from permalloy, ferronickel alloy or Mu-metal alloy wire (or strip) that have high magnetic permeability. To match the shape of the magnetic conductive material, the coil may be in a shape of circular, square, rectangular and other shapes.

Figure 2:
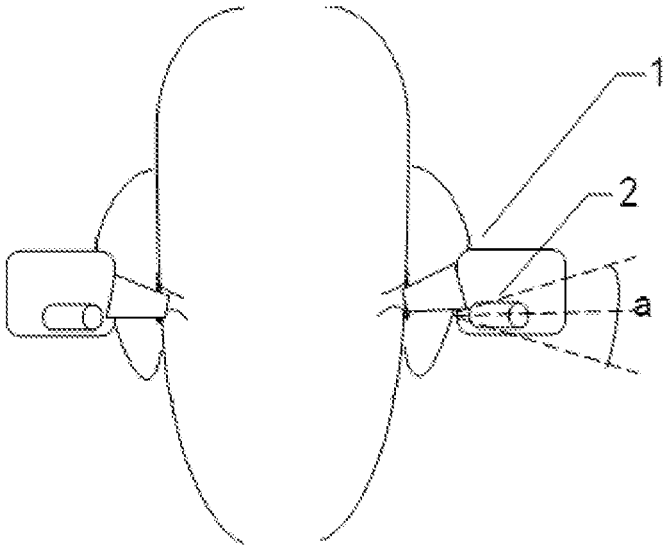
FIG. 2 is a schematic diagram showing stacking of a coil in a compact in-ear earphone according to an embodiment.
Figure 3:
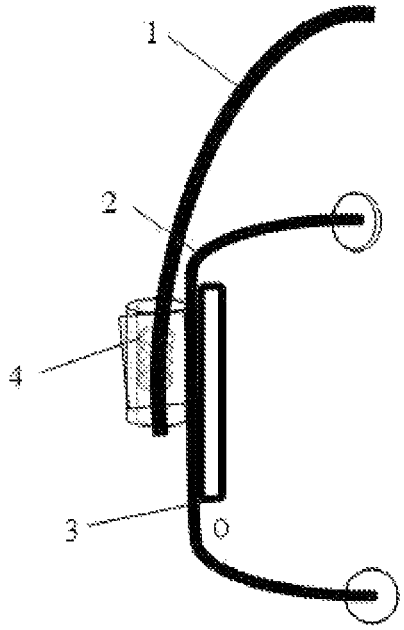
FIG. 3 is a schematic diagram of showing stacking of a coil in a headphone or an on-ear earphone according to an embodiment.
Figure 4:
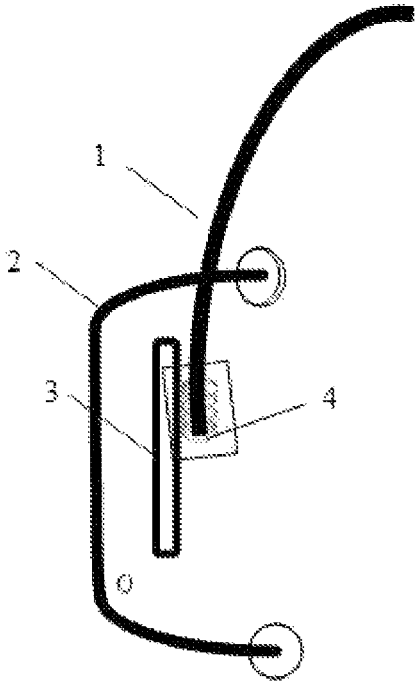
FIG. 4 is a schematic diagram of showing stacking of a coil in a headphone or an on-ear earphone according to another embodiment.

For a compact in-ear earphone, such as a true wireless stereo (TWS) earphone, as shown in FIG. 2, 1 represents a TWS earphone, 2 represents a coil, and a represents an angle at which the coil is arranged. After a magnetic core coil is arranged in the TWS earphone, the magnetic induction intensity is enhanced and an axial angle difference has a good tolerance. The coil, when being arranged, may be rotated by an angle a, where a is usually less than 45 degrees. FIG. 3 and FIG. 4 respectively show stacking of a coil in a headphone and in an on-ear earphone. In FIG. 3 and FIG. 4, 1 represents a headband, 2 represents an earphone shell, 3 represents a circuit board and 4 represents a coil.

A method for reducing noise of a wireless-earphone is provided according to an embodiment of the present disclosure to improve the noise reduction quality of the wireless-earphone.

Figure 5:
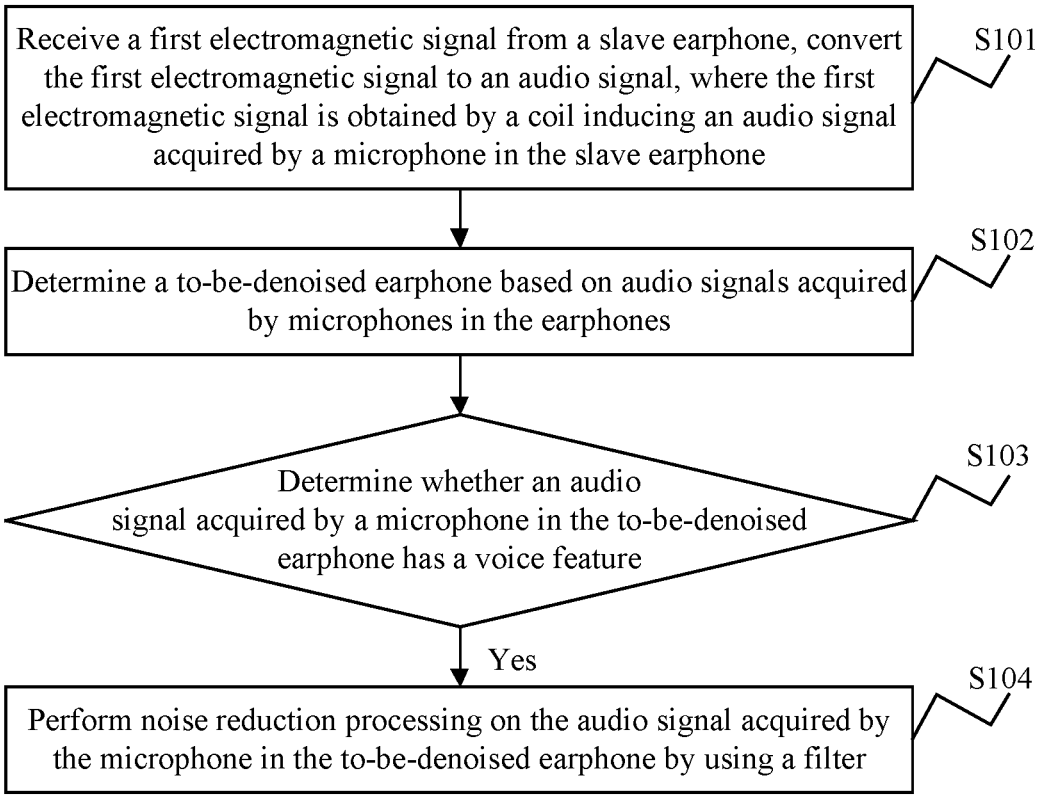
FIG. 5 is a flow chart of a method for reducing noise of a wireless-earphone according to an exemplary embodiment.

Reference is made to FIG. 5, which shows a flow chart of a method for reducing noise of a wireless-earphone according to an exemplary embodiment. As shown in FIG. 5, the method includes the following steps S101 to S104.

In step S101, a first electromagnetic signal from a slave earphone is received, and the first electromagnetic signal is converted to an audio signal. The first electromagnetic signal is obtained by a coil inducing an audio signal acquired by a microphone in the slave earphone.

In the embodiment, the master earphone in the communication architecture serves as an execution subject to perform noise reduction processing on the audio signal obtained by the wireless-earphone. The master earphone is electromagnetically connected with the slave earphone. That is, the slave earphone induces the audio signal acquired by the microphone to an electromagnetic signal, that is the first electromagnetic signal in this step, by using a coil, and transmits the first electromagnetic signal to a coil of the master earphone. The master earphone converts the received first electromagnetic signal to an audio signal for subsequent processing.

In step S102, a to-be-denoised earphone is determined based on audio signals acquired by microphones in the earphones.

In this step, it is determined to perform noise reduction processing based on a mic array of which earphone based on the audio signals acquired by the microphones in the earphones, that is, the to-be-denoised earphone is determined. In an embodiment, each of the earphones may be assigned an enabling parameter. The enabling parameter represents a sound energy of an audio signal acquired by the master earphone. That is, this step may include the following operations. For each of the earphones, an enabling parameter corresponding to the earphone is determined based on a predetermined sound pressure range and an audio signal acquired by a microphone in the earphone. The enabling parameter is positively correlated with a sound energy of the audio signal. In a case that a first enabling parameter and a second enabling parameter are both less than a predetermined value, the master earphone is determined as the to-be-denoised earphone. The first enabling parameter and the second enabling parameter correspond to different earphones. In a case that at least one of a first enabling parameter and a second enabling parameter is greater than or equal to a predetermined value and a difference between the first enabling parameter and the second enabling parameter is not within a predetermined range, an earphone corresponding to a target enabling parameter is determined as the to-be-denoised earphone. The target enabling parameter is a minimum of the first enabling parameter and the second enabling parameter. In a case that at least one of a first enabling parameter and a second enabling parameter is greater than or equal to a predetermined value and a difference between the first enabling parameter and the second enabling parameter is within a predetermined range, each of the earphones is determined as the to-be-denoised earphone.

In practices, an enabling parameter of the left earphone is represented by al, and may be determined based on a signal acquired by a primary mic of the left earphone. An enabling parameter of the right earphone is represented by ar, and may be determined based on a signal acquired by a primary mic of the right earphone. Each of the master earphone and the slave earphone in the wireless-earphone acquires an audio signal by using a mic. Each of the master earphone and the slave earphone include multiple mics, a mic near the mouth serve as the primary mic. In a case that an energy of a signal acquired by a secondary mic is more than 20 dB greater than of an energy of a signal acquired by the primary mic due to damage of the primary mic or blocking of sound holes of the primary mic, it is determined that the primary mic is faulty, and the parameter al or ar is determined based on the signal acquired by the secondary mic. For the predetermined sound pressure range, a maximum boundary is configured as a background noise level A at which an original recording of a mic is broken, for example, the maximum boundary may be configured as 100 dBA based on the arrangements of the mic and a pre-amplifier of the mic; and a minimum boundary is configured as a level B at which a person speaks in a low voice, for example, the minimum boundary may be configured as 60 dBA. In a case that it is detected that the sound energy is greater than or equal to A, it is determined that the noise is too strong, and al or ar is determined as 1. In a case that it is detected that the sound energy is less than B, it is determined that no useful sound signal is acquired by the earphone and the sound signal may be ignored, and al or ar is determined as 0. al and ar vary from 0 to 1 while the sound energy varies from B to A, and a greater sound energy indicates that al or ar is greater.

In a case that al and ar are both equal to 0, it is determined that the user is not speaking, and it is unnecessary to perform signal processing to save energy. In a case that al and ar are both greater than 0 and less than the predetermined value (such as 0.7), only an earphone in a primary connection with an external device is used, that is, mic noise reduction algorithm processing is performed in the master earphone. In a case that at least one of al and ar is greater than or equal to the predetermined value, and a difference between al and ar is greater than a threshold (such as 0.2), it is determined that an energy of a signal acquired by an earphone corresponding to a larger one of al and ar is too large for signal processing, and mic noise reduction algorithm processing is performed in an earphone corresponding to a smaller one of al and ar. In a case that at least one of al and ar is greater than or equal to the predetermined value and a difference between al and ar is less than or equal to a threshold, it is determined that energy of the environment noise is too large and the noise source has no obvious directivity, and it is required to perform mic noise reduction algorithm processing in the left earphone and the right earphone, and then the slave earphone transmits a processing result to the master earphone through electromagnetic induction for further noise processing.

In step S103, it is determined whether an audio signal acquired by a microphone in the to-be-denoised earphone has a voice feature. In a case that the audio signal acquired by the microphone in the to-be-denoised earphone has the voice feature, proceed to step S104.

In the embodiment, noise reduction processing is performed on an audio signal having a voice feature to reduce the power consumption of the earphone. The determination manner is not limited herein. In an embodiment, it is determined whether the audio signal has the voice feature by performing envelope energy detection. That is, this step may include the following operations. Envelope detection is performed on the audio signal acquired by the microphone in the to-be-denoised earphone to obtain an envelope energy. In a case that the envelope energy is greater than a first threshold, zero-crossing rate detection is performed on the audio signal acquired by the microphone in the to-be-denoised earphone to obtain a zero-crossing rate. In a case that the zero-crossing rate is greater than a second threshold, it is determined that the audio signal acquired by the microphone in the to-be-denoised earphone has the voice feature.

In practices, an initial envelope energy power is equal to zero, and the envelope energy is calculated by using the following equation:

$$\text{power}=\text{power}(1-\alpha)+x(n)\Sigma_{n=1}^{N}x(n)$$

where detection sensitivity may be controlled by adjusting parameters of alpha and N, $\alpha$ alpha represents an iteration speed and may be set to 0.1, N represents a length of one frame of data in signal processing, and x(n) represents an inputted audio signal.

In a case that power is greater than the first threshold, zero-crossing rate detection is performed. The zero-crossing rate Z_rate is calculated by using the following equation:

$$\text{Z_rate} = \frac{1}{2}\sum_{n=0}^{N-1} |\text{sgn}(x(n)) - \text{sgn}(x(n-1))|$$

-continued $$\text{where, } \operatorname{sgn}(x) = \begin{cases} 1 & x > 0 \\ -1, & x < 0 \end{cases}$$

In a case that the zero-crossing rate is greater than the second threshold, it is determined that the acquired signal has the voice feature and the acquired signal includes voice. The first threshold and the second threshold may be flexibly configured according to actual conditions, which are not limited herein.

In step S104, noise reduction processing is performed on the audio signal acquired by the microphone in the to-be-denoised earphone by using a filter.

Figure 6:
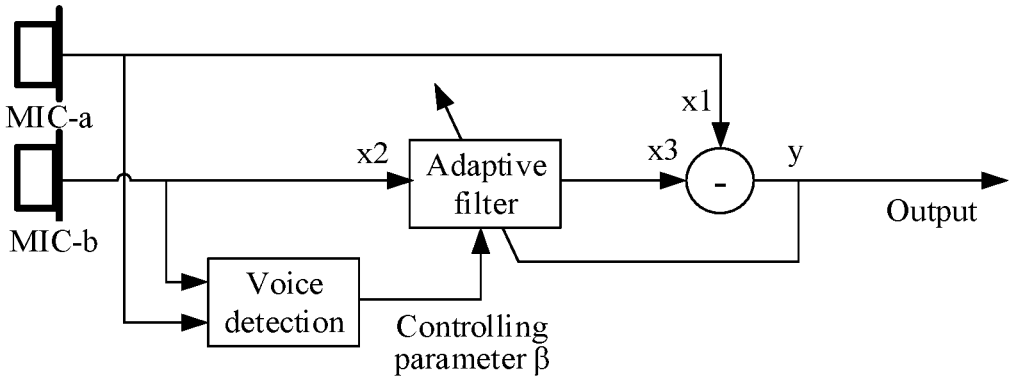
FIG. 6 is a schematic diagram showing noise reduction of a filter in an earphone.

In this step, as shown in FIG. 6, noise reduction processing is performed on the audio signal acquired by the microphone in the to-be-denoised earphone by using a filter. In FIG. 6, Mic-a represents a microphone, Mic-b represents another microphone, x1 represents an audio signal acquired by the microphone, x2 represents an audio signal acquired by Mic-b, x3 represents an output of the filter, and y represents a final result of the noise reduction processing.

In an embodiment, a controlling parameter of an updating speed of a weight of the filter may be determined based on the audio signals acquired by Mic-a and Mic-b. That is, this step may include the following operations. A controlling parameter of the filter is determined based on the envelope energy of the audio signal acquired by the microphone in the to-be-denoised earphone. The controlling parameter represents the updating speed of the weight of the filter, and a constraint of the filter is equal to a product of the controlling parameter and the weight. Noise reduction processing is performed on the audio signal acquired by the microphone in the to-be-denoised earphone by using the filter.

In an embodiment, the operation of determining a controlling parameter of the filter based on the envelope energy of the audio signal acquired by a microphone in the to-be-denoised earphone may include the following steps. The envelope energy corresponding to the audio signal acquired by the microphone in the to-be-denoised earphone is determined as a first envelope energy. A candidate microphone other than the microphone is selected to preform envelope detection on an audio signal acquired by the candidate microphone to obtain a second envelope energy. The controlling parameter of the filter is determined based on a ratio of the first envelope energy to the second envelope energy. The controlling parameter is negatively correlated with the ratio, and the updating speed of the weight of the filter is positively correlated with the controlling parameter.

The ratio of the first envelope energy to the second envelope energy is calculated by using the following equation:

$$P_\text{ratio}=\text{power(mic1)}/\text{power(mic2)}.$$

A greater P_ratio indicates that a possibility of an existence of a voice is greater and the controlling parameter is smaller. Specifically, the controlling parameter ranges from 0 to 1, P_ratio is less than 0 dB, and the controlling parameter is equal to 1. For a wireless compact in-ear earphone, the controlling parameter is equal to zero in a case that P_ratio is greater than 2 dB. For a wireless ear-cup earphone or a wireless on-ear earphone, the controlling parameter is equal to 0 in a case that P_ratio is greater than 4 dB.

The order of the filter described above may be 128. A signal x2 is inputted to an adaptive filter, the filter outputs a signal x3. A subtraction operation is performed on x3 and x1 to obtain a signal y. y is fed back to the adaptive filter to update the weight of the filter. The updating speed of the weight of the filter is controlled based on the controlling parameter. When residual noise reaches a minimum value, the filtering process ends.

In a case that a controlling parameter β is equal to zero, it is determined that the acquired audio signal is voice of the user, the filter is completely constrained, the updating speed is reduced, thus the quality of the signal is protected. In a case that a controlling parameter β is greater than zero and less than 1, that is, the audio signal includes voice and noise, processing speed is regulated based on the value of β, the filter is partially constrained, thus the noise is partially eliminated and the voice is completely retained. In a case that β is equal to 1, it is determined that the acquired audio signal only includes noise, the filter is iterated quickly, and thus the noise is completely eliminated.

In the method for reducing noise of a wireless-earphone according to the embodiments of the present disclosure, no connection line is arranged between the left earphone and the right earphone, improving wearing experience of the user. The communication between the two earphones is performed through wireless electromagnetic waves, avoiding the interference between the signal lines according to the conventional technology, thereby achieving high-quality signal transmission. With the method according to the present disclosure, mic noise reduction design is performed in each of the left earphone and the right earphone, and the to-be-denoised earphone can be determined based on an actual audio signal, thereby improving the quality of noise reduction processing and the communication experience of the user.

A method for reducing noise of a wireless-earphone is provided according to an embodiment of the present disclosure. Compared with the method in the embodiments described above, the technical solutions are further illustrated and optimized in the embodiment.

Figure 7:
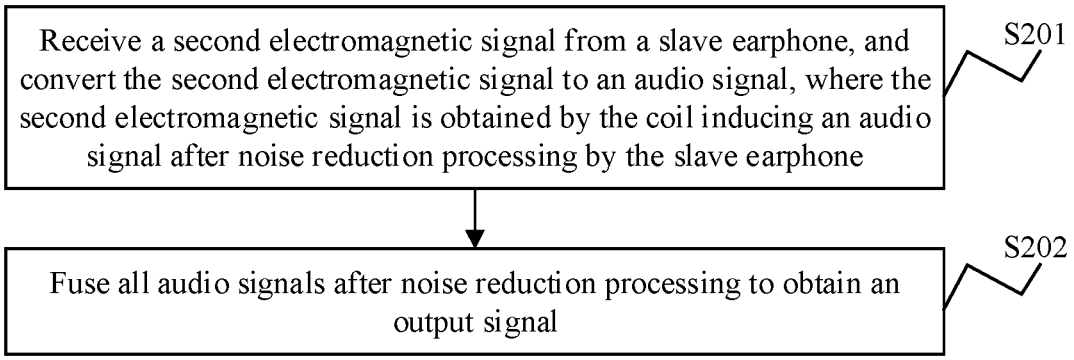
FIG. 7 is a flow chart of a method for reducing noise of a wireless-earphone according to an exemplary embodiment.

Reference is made to FIG. 7, which shows a flow chart of a method for reducing noise of a wireless-earphone according to an exemplary embodiment. As shown in FIG. 7, the method includes the following steps S201 and S202.

In step S201, a second electromagnetic signal from the slave earphone is received, and the second electromagnetic signal is converted to an audio signal. The second electromagnetic signal is obtained by the coil inducing an audio signal after noise reduction processing by the slave earphone.

In the embodiment, in a case that each of the earphones is the to-be-denoised earphone, after performing noise reduction processing on the audio signal acquired by the microphone in the to-be-denoised earphone by using the filter, the slave earphone transmits the electromagnetic signal, that is the second electromagnetic signal in this step, obtained by the coil inducing the audio signal after noise reduction processing to the master earphone. Then, the master earphone fuses all audio signals after noise reduction processing.

In step S202, all audio signals after noise reduction processing are fused to obtain an output signal.

In an embodiment, as shown in FIG. 7, this step may include the following operations. Time-frequency domain conversion is performed on all the audio signals after noise reduction processing to acquire multiple frequency-domain signals. Cepstrum processing is performed on each of the frequency-domain signals, and signal fusion is performed in a cepstrum domain to obtain a fused signal. Inverse cepstrum processing is performed on the fused signal to obtain a target frequency-domain signal, and the target frequency-domain signal is converted to a target time-domain signal. The target time-domain signal is determined as the output signal.

In practices, in a case that at least one of al and ar is greater than or equal to the predetermined value and a difference between al and ar is less than or equal to a threshold, it is determined that energy of the environment noise is too large and the noise source has no obvious directivity, and it is required to perform mic noise reduction algorithm processing in the left earphone and the right earphone and then perform fusion processing. First, time-frequency domain conversion is performed on the audio signals after noise reduction processing to obtain frequency-domain signals. The time-frequency domain conversion is not limited herein. For example, a fast Fourier transformation (FFT) or a modified discrete cosine transform (MDCT) may be performed. Then, cepstrum processing is performed on the frequency-domain signals, and signal fusion may be performed in a cepstrum domain. Then, inverse cepstrum processing is performed on the fused signal to obtain frequency-domain signals, and time-frequency conversion is performed to obtain time-domain signals, thus the signals are fused. By fusing the audio signals, the signal-to-noise ratio of voice communication can be further improved in a loud-noise condition, thereby improving the communication quality.

Hereinafter, a device for reducing noise of a wireless-earphone according to an embodiment of the present disclosure is described. The device for reducing noise of a wireless-earphone described below and the method for reducing noise of a wireless-earphone described above may be cross-referenced.

Figure 8:
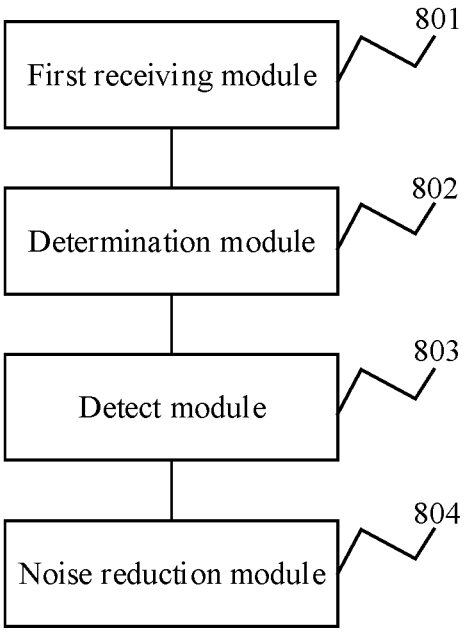
FIG. 8 is a schematic structural diagram of a device for reducing noise of a wireless-earphone according to an exemplary embodiment.

Reference is made to FIG. 8, which shows a schematic structural diagram of a device for reducing noise of a wireless-earphone according to an exemplary embodiment. As shown in FIG. 8, the device includes a first receiving module 801, a determination module 802, a detection module 803 and a noise reduction module 804.

The first receiving module 801 is configured to receive a first electromagnetic signal from a slave earphone, and convert the first electromagnetic signal to an audio signal. The first electromagnetic signal is obtained by a coil inducing an audio signal acquired by a microphone in the slave earphone.

The determination module 802 is configured to determine a to-be-denoised earphone based on audio signals acquired by microphones in the earphones.

The detection module 803 is configured to determine whether an audio signal acquired by a microphone in the to-be-denoised earphones has a voice feature, and trigger the noise reduction module 803 to operate in a case that the audio signal acquired by the microphone in the to-be-denoised earphone has the voice feature.

The noise reduction module 804 is configured to perform noise reduction processing on the audio signal acquired by the microphone in the to-be-denoised earphone by using a filter.

In the device for reducing noise of a wireless-earphone according to the embodiments of the present disclosure, no connection line is arranged between the left earphone and the right earphone, improving wearing experience of the user. The communication between the two earphones is performed through wireless electromagnetic waves, avoiding the interference between the signal lines according to the conventional technology, thereby achieving high-quality signal transmission. With the device according to the present disclosure, mic noise reduction design is performed in each of the left earphone and the right earphone, and the to-be-denoised earphone can be determined based on an actual audio signal, thereby improving the quality of noise reduction processing and the communication experience of the user.

Based on the above embodiments, in a preferred embodiment, the determination module 802 includes a determination enabling parameter unit, a first determination unit, a second determination unit and a third determination unit.

The determination enabling parameter unit is configured to determine, for each of the earphones, an enabling parameter corresponding to the earphone based on a predetermined sound pressure range and an audio signal acquired by a microphone in the earphone. The enabling parameter is positively correlated with a sound energy of the audio signal.

The first determination unit is configured to determine, in a case that a first enabling parameter and a second enabling parameter are both less than a predetermined value, the master earphone as the to-be-denoised earphone. The first enabling parameter and the second enabling parameter correspond to different earphones.

The second determination unit is configured to determine, in a case that at least one of a first enabling parameter and a second enabling parameter is greater than or equal to a predetermined value and a difference between the first enabling parameter and the second enabling parameter is not within a predetermined range, an earphone corresponding to a target enabling parameter as the to-be-denoised earphone. The target enabling parameter is a minimum of the first enabling parameter and the second enabling parameter.

The third determination unit is configured to determine, in a case that at least one of a first enabling parameter and a second enabling parameter is greater than or equal to a predetermined value and a difference between the first enabling parameter and the second enabling parameter is within a predetermined range, each of the earphones as the to-be-denoised earphone.

Based on the above embodiments, in a preferred embodiment, the detection module 803 includes an envelope detection unit, a zero-crossing rate detection unit and a determination unit.

The envelope detection unit is configured to perform envelope detection on the audio signal acquired by the microphone in the to-be-denoised earphone to obtain an envelope energy.

The zero-crossing rate detection unit is configured to perform, in a case that the envelope energy is greater than a first threshold, zero-crossing rate detection on the audio signal acquired by the microphone in the to-be-denoised earphone to obtain a zero-crossing rate.

The determination unit is configured to trigger the noise reduction module 803 to operate in a case that the zero-crossing rate is greater than a second threshold.

Based on the above embodiments, in a preferred embodiment, the noise reduction module 804 includes a controlling parameter determination unit and a noise reduction unit.

The controlling parameter determination unit is configured to determine a controlling parameter of the filter based on the envelope energy of the audio signal acquired by the microphone in the to-be-denoised earphone. The controlling parameter represents an updating speed of a weight of the filter, and a constraint of the filter is equal to a product of the controlling parameter and the weight.

The noise reduction unit is configured to perform the noise reduction processing on the audio signal acquired by the microphone in the to-be-denoised earphone by using the filter.

Based on the above embodiments, in a preferred embodiment, the controlling parameter determination unit includes a first detection subunit, a second detection subunit and a determination subunit.

The first detection subunit is configured to determine the envelope energy of the audio signal acquired by the microphone in the to-be-denoised earphone as a first envelope energy.

The second detection subunit is configured to select a candidate microphone other than the microphone to preform envelope detection on an audio signal acquired by the candidate microphone to obtain a second envelope energy.

The determination subunit is configured to determinate the controlling parameter of the filter based on a ratio of the first envelope energy to the second envelope energy. The controlling parameter is negatively correlated with the ratio, and the updating speed of the weight of the filter is positively correlated with the controlling parameter.

Based on the above embodiments, in a preferred embodiment, in a case that each of the earphones is the to-be-denoised earphone, the device further includes a second receiving module and a fusion module.

The second receiving module is configured to receive a second electromagnetic signal from the slave earphone, and convert the second electromagnetic signal to an audio signal. The second electromagnetic signal is obtained by the coil inducing an audio signal after noise reduction processing by the slave earphone.

The fusion module is configured to fuse all audio signals after noise reduction processing to obtain an output signal.

Based on the above embodiments, in a preferred embodiment, the fusion module includes a first conversion unit, a fusion unit, a second conversion unit and an output unit.

The first conversion unit is configured to perform time-frequency domain conversion on all the audio signals after noise reduction processing to acquire multiple frequency-domain signals.

The fusion unit is configured to perform cepstrum processing on each of the frequency-domain signals, and perform signal fusion in a cepstrum domain to obtain a fused signal.

The second conversion unit is configured to perform inverse cepstrum processing on the fused signal to obtain a target frequency-domain signal, and convert the target frequency-domain signal to a target time-domain signal.

The output unit is configured to determine the target time-domain signal as the output signal.

For the device according to the embodiments described above, the manners in which the modules perform operations have been described in detail in the embodiments of the method, which are not described in detail herein.

Figure 9:
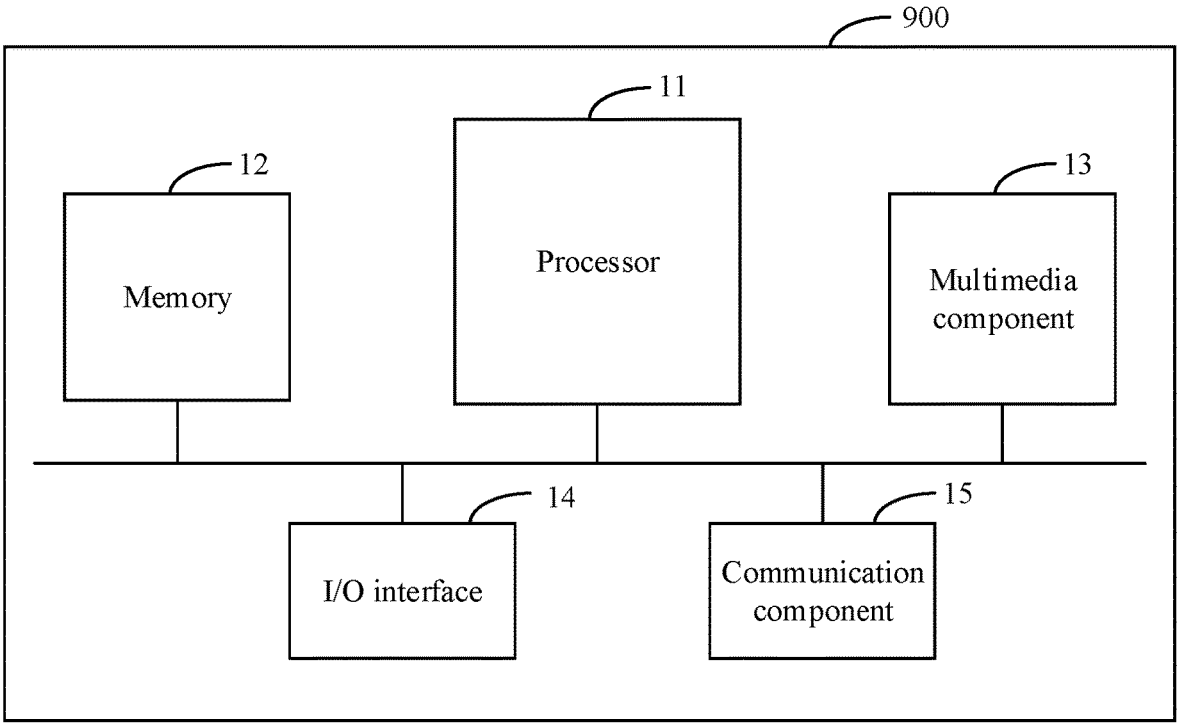
FIG. 9 is a schematic structural diagram of a wireless-earphone according to an exemplary embodiment.

A wireless-earphone is further provided according to the present disclosure. Reference is made to FIG. 9, which shows a schematic structural diagram of a wireless-earphone 900 according to an embodiment of the present disclosure. As shown in FIG. 9, the wireless-earphone 900 may include a processor 11 and a memory 12. The wireless-earphone 900 may further include one or more of a multimedia component 13, an input/output (I/O) interface 14, and a communication component 15.

The processor 11 is configured to control overall operation of the wireless-earphone 900 to perform all or a part of steps of the method for reducing noise of a wireless-earphone. The memory 12 stores various types of data to support the operation of the wireless-earphone 900. The data may include, for example, instructions of any application or method to be operated on the wireless-earphone 900, and include application-related data, such as contact data, received and transmitted messages, pictures, audios and videos. The memory 12 may be implemented by any type of volatile or nonvolatile storage device or a combination thereof, such as, a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic disk or an optical disc. The multimedia component 13 may include an audio component for outputting and/or inputting audio signals. For example, the audio component may include a microphone for receiving an external audio signal. The received audio signal may be stored in the memory 12 or be transmitted by the communication component 15. The audio component further includes at least one speaker for outputting an audio signal. The I/O interface 14 provides interfaces between the processor 11 and other interface modules. The other interface modules may be a keyboard, a mouse, a button and the like. The button may be a virtual button or a physical button. The communication component 15 is used for wired communication or wireless communication between the wireless-earphone 900 and other devices. The wireless communication may be based on, for example, Wi-Fi technology, Bluetooth technology, near field communication (NFC), 2G, 3G or 4G, or a combination thereof. Therefore, the communication component 15 may include a Wi-Fi module, a Bluetooth module and an NFC module.

In an exemplary embodiment, the wireless-earphone 900 may be implemented by one or more application specific integrated circuits (ASICs), digital signal processors (DSPs), digital signal processing devices (DSPDs), programmable logic devices (PLDs), field programmable gate arrays (FPGAs), controllers, microcontrollers, microprocessors or other electronic components to perform the method for reducing noise of a wireless-earphone.

In another exemplary embodiment, a computer-readable storage medium storing program instructions is further provided. The program instructions, when executed by a processor, cause the processor to perform the method for reducing noise of a wireless-earphone. For example, the computer-readable storage medium may be the memory 12 storing program instructions. The program instructions may be executed by the processor 11 of the wireless-earphone 900 to perform the method for reducing noise of a wireless-earphone.

The embodiments in this specification are described in a progressive way, each of which emphasizes the differences from others, and the same or similar parts among the embodiments can be referred to each other. Since the device disclosed in the embodiments corresponds to the method therein, the description thereof is relatively simple, and for relevant matters references may be made to the description of the method. It should be noted that improvements and modifications may be made to the present disclosure by those skilled in the art without departing from the concept of the present disclosure. These improvements and modifications shall fall within the scope of the claims of the present disclosure.

It should be further noted that in this specification, the relationship terminologies such as "first" and "second" and the like are only used herein to distinguish one entity or operation from another, rather than to necessitate or imply that the actual relationship or order exists between the entities or operations. Moreover, terms of "include", "comprise" or any other variants are intended to be non-exclusive. Therefore, a process, method, article, or device including multiple elements includes not only the elements but also other elements that are not enumerated, or also includes the elements inherent for the process, method, article or device. Unless expressively limited otherwise, the statement "comprising (including) one . . . " does not exclude the case that other similar elements may exist in the process, method, article or device.

What is claimed is:

1. A method for reducing noise of a wireless-earphone, wherein each of earphones comprised in the wireless-earphone is arranged with a plurality of microphones, and the earphones are electromagnetically connected with each other via coils, wherein the method is applied to a master earphone of the wireless-earphone and comprises:

receiving a first electromagnetic signal from a slave earphone, and converting the first electromagnetic signal to an audio signal, wherein the first electromagnetic signal is obtained by a coil inducing an audio signal acquired by a microphone in the slave earphone;

determining a to-be-denoised earphone based on audio signals acquired by microphones in the earphones;

determining whether an audio signal acquired by a microphone in the to-be-denoised earphone has a voice feature; and performing noise reduction processing on the audio signal acquired by the microphone in the to-be-denoised earphone by using a filter in a case that the audio signal acquired by the microphone in the to-be-denoised earphone has the voice feature.

2. The method for reducing noise of a wireless-earphone according to claim 1, wherein the determining a to-be-denoised earphone based on audio signals acquired by microphones in the earphones comprises:

determining, for each of the earphones, an enabling parameter corresponding to the earphone based on a predetermined sound pressure range and an audio signal acquired by a microphone in the earphone, wherein the enabling parameter is positively correlated with a sound energy of the audio signal;

in a case that a first enabling parameter and a second enabling parameter are both less than a predetermined value, determining the master earphone as the to-be-denoised earphone, wherein the first enabling parameter and the second enabling parameter correspond to different earphones;

in a case that at least one of a first enabling parameter and a second enabling parameter is greater than or equal to a predetermined value and a difference between the first enabling parameter and the second enabling parameter is not within a predetermined range, determining an earphone corresponding to a target enabling parameter as the to-be-denoised earphone, wherein the target enabling parameter is a minimum of the first enabling parameter and the second enabling parameter; and in a case that at least one of a first enabling parameter and a second enabling parameter is greater than or equal to a predetermined value and a difference between the first enabling parameter and the second enabling parameter is within a predetermined range, determining each of the earphones as the to-be-denoised earphone.

3. The method for reducing noise of a wireless-earphone according to claim 1, wherein the determining whether an audio signal acquired by a microphone in the to-be-denoised earphone has a voice feature comprises:

performing envelope detection on the audio signal acquired by the microphone in the to-be-denoised earphone to obtain an envelope energy;

performing, in a case that the envelope energy is greater than a first threshold, zero-crossing rate detection on the audio signal acquired by the microphone in the to-be-denoised earphone to obtain a zero-crossing rate; and determining, in a case that the zero-crossing rate is greater than a second threshold, that the audio signal acquired by the microphone in the to-be-denoised earphone has the voice feature.

4. The method for reducing noise of a wireless-earphone according to claim 3, wherein the performing noise reduction processing on the audio signal acquired by the microphone in the to-be-denoised earphone by using a filter comprises:

determining a controlling parameter of the filter based on the envelope energy of the audio signal acquired by the microphone in the to-be-denoised earphone, wherein the controlling parameter represents an updating speed of a weight of the filter, and a constraint of the filter is equal to a product of the controlling parameter and the weight; and performing the noise reduction processing on the audio signal acquired by the microphone in the to-be-denoised earphone by using the filter.

5. The method for reducing noise of a wireless-earphone according to claim 4, wherein the determining a controlling parameter of the filter based on the envelope energy of the audio signal acquired by the microphone in the to-be-denoised earphone comprises:

determining the envelope energy of the audio signal acquired by the microphone in the to-be-denoised earphone as a first envelope energy;

selecting a candidate microphone other than the microphone to perform envelope detection on an audio signal acquired by the candidate microphone to obtain a second envelope energy; and determining the controlling parameter of the filter based on a ratio of the first envelope energy to the second envelope energy, wherein the controlling parameter is negatively correlated with the ratio, and the updating speed of the weight of the filter is positively correlated with the controlling parameter.

6. The method for reducing noise of a wireless-earphone according to claim 1, wherein in a case that each of the earphones is the to-be-denoised earphone, after performing the noise reduction processing on the audio signal acquired by the microphone in the to-be-denoised earphone by using the filter, the method further comprises:

receiving a second electromagnetic signal from the slave earphone, and converting the second electromagnetic signal to an audio signal, wherein the second electromagnetic signal is obtained by the coil inducing an audio signal after noise reduction processing by the slave earphone; and fusing all audio signals after noise reduction processing to obtain an output signal.

7. The method for reducing noise of a wireless-earphone according to claim 6, wherein the fusing all audio signals after noise reduction processing to obtain an output signal comprises:

performing time-frequency domain conversion on all the audio signals after noise reduction processing to obtain a plurality of frequency-domain signals;

performing cepstrum processing on each of the frequency-domain signals, and performing signal fusion in a cepstrum domain to acquire a fused signal;

performing inverse cepstrum processing on the fused signal to obtain a target frequency-domain signal, and converting the target frequency-domain signal to a target time-domain signal; and determining the target time-domain signal as the output signal.

8. A device for reducing noise of a wireless-earphone, wherein each of earphones comprised in the wireless-earphone is arranged with a plurality of microphones, and the earphones are electromagnetically connected with each other via coils, wherein the device is applied to a master earphone of the wireless-earphone and comprises:

a first receiving module, configured to receive a first electromagnetic signal from a slave earphone, and convert the first electromagnetic signal to an audio signal, wherein the first electromagnetic signal is obtained by a coil inducing an audio signal acquired by a microphone in the slave earphone;

a determination module, configured to determine a to-be-denoised earphone based on audio signals acquired by microphones in the earphones;

a detection module, configured to determine whether an audio signal acquired by a microphone in the to-be-denoised earphone has a voice feature, and trigger a noise reduction module to operate in a case that the audio signal acquired by the microphone in the to-be-denoised earphone has the voice feature; and the noise reduction module, configured to perform noise reduction processing on the audio signal acquired by the microphone in the to-be-denoised earphone by using a filter.

9. A wireless-earphone, wherein each of earphones comprised in the wireless-earphone is arranged with a plurality of microphones, and the earphones are electromagnetically connected with each other via coils, wherein a master earphone of the wireless-earphone comprises:

a memory, storing a computer program; and a processor, configured to perform, when executing the computer program, the method for reducing noise of a wireless-earphone according to claim 1.

10. The wireless-earphone according to claim 9, wherein each of the coils is arranged with magnetic conductive material.

11. A non-transitory computer-readable storage medium storing a computer program, wherein the computer program, when executed by a processor, causes the processor to perform the method for reducing noise of a wireless-earphone according to claim 1.

* * * * *